US005253955A

United States Patent [19]

Walbrohl

[11] Patent Number: 5,253,955

[45] Date of Patent: Oct. 19, 1993

[54] AUTOMATICALLY ADVANCING SUPPORTING AND SLIDING FORM FOR INTRODUCING AN IN-SITU CONCRETE LINING

[76] Inventor: Heinz-Theo Walbrohl, Nordstr. 73, D-5300, Bonn 1, Fed. Rep. of Germany

[21] Appl. No.: 916,010

[22] PCT Filed: Jan. 30, 1991

[86] PCT No.: PCT/EP91/00171

§ 371 Date: Jul. 29, 1992

§ 102(e) Date: Jul. 29, 1992

[87] PCT Pub. No.: WO91/11590

PCT Pub. Date: Aug. 8, 1991

[30] Foreign Application Priority Data

Jan. 30, 1990 [DE] Fed. Rep. of Germany ..... 4002669

[51] Int. Cl.[5] ..... E21D 11/10

[52] U.S. Cl. ..... 405/147; 264/31; 264/32; 405/140; 405/146; 405/150.1; 425/59

[58] Field of Search ..... 405/146, 145, 140, 147, 405/150.1, 138, 288, 290, 291; 249/9-13; 425/59, 63; 264/31-36

[56] References Cited

U.S. PATENT DOCUMENTS

| | | | |
|---|---|---|---|
| 3,438,208 | 4/1969 | Heeringa | 405/138 |
| 3,823,566 | 7/1974 | Handewith | 405/143 X |
| 3,877,855 | 4/1975 | Hanson | 425/59 |
| 4,261,542 | 4/1981 | Lefebvre | 425/59 X |
| 4,437,788 | 3/1984 | Walbröhl . | |
| 4,439,064 | 3/1984 | Van der Gaarden | 405/146 X |
| 4,710,058 | 12/1987 | Han | 405/150.1 X |
| 4,769,192 | 9/1988 | Cerutti | 425/59 X |
| 4,856,936 | 8/1989 | Hentochel et al. . | |

FOREIGN PATENT DOCUMENTS

| | | | |
|---|---|---|---|
| 1109630 | 6/1961 | Fed. Rep. of Germany | 405/291 |
| 1201288 | 9/1965 | Fed. Rep. of Germany | 405/291 |
| 2654565 | 6/1978 | Fed. Rep. of Germany . | |
| 2908540 | 9/1980 | Fed. Rep. of Germany | 405/140 |
| 1450116 | 12/1973 | United Kingdom . | |
| 2044333 | 10/1980 | United Kingdom | 405/291 |

*Primary Examiner*—Dennis L. Taylor

*Attorney, Agent, or Firm*—Anthony J. Casella; Gerald E. Hespos

[57] ABSTRACT

A slide formwork with a formwork body (10) comprising several formwork segment groups (12, 22, 32) lying adjacent to one another in circumferential direction. Each of the formwork segment groups (12, 22, 32) is rigidly connected with one of several support frames (40) and is mounted onto the remaining support frames in slidable manner. Each formwork segment (14) comprises an outer formwork plate (16) supported on an associated longitudinal carrier (18) via hydraulic elements. The formwork plate (16) and associated longitudinal carrier (18) are coupled with one another in non-shiftable manner in longitudinal direction. Hydraulic presses (52) are arranged between the individual support frames (40), with which each support frame is shiftable with respect to the remaining support frames.

17 Claims, 5 Drawing Sheets

AUTOMATICALLY ADVANCING SUPPORTING AND SLIDING FORM FOR INTRODUCING AN IN-SITU CONCRETE LINING

The invention relates to a self-travelling support and slide formwork for producing a concrete lining. Such a support and slide formwork is normally employed selectively in continuous, discontinuous or charge-wise concreting operation.

In a known travelling support and slide formwork of this type (DE 30 43 312 A1), advancement takes place by the pressure of the concrete, which is introduced under pressure into the section of the annulus located behind the front formwork. The known slide formwork of this type is principly suited for a continuous, discontinuous or charge-wise concreting operation. However, even in continuous operation, especially for relatively thin concrete walls, the force of the concrete pumped into the region of the front formwork is often not sufficient to move the entire formwork forwards. For discontinuous or charge operation, where the forward movement of the formwork is interrupted when concreting is stopped, tension or compression forces must be provided, which are supported externally, i.e. outside of the formwork itself.

For charge operation, where the formworking and concreting take place sequentially, formworks are known consisting of elements which can be folded or lowered and which lie on a support construction drivable along the axis of the tunnel. This formwork has the disadvantage that the work associated with formworking and assembling is very time and cost intensive.

A further disadvantage is that the formwork can only be removed from the concrete when it has finally reached its load-carrying capacity, leading to delay times which are economically relevant.

The special conditions in gallery or tunnel construction or also shaft construction require a concrete formwork, which on the one hand can slide forward either continuously or discontinuously and, on the other hand, can be converted to a charge-wise concreting operation when required without effort, for example when special reinforcements are needed in particularly loaded sections of the structure or when sections are to be left open for recesses or cross channels, etc. The object of the present invention is to provide a self-travelling support and slide formwork, which in conjunction with a free selection among continuous, discontinuous or charge operation, enables the advancement of the formwork in all three types of operation under normal operation conditions, without the necessity of external counter-support points for tension or compression forces at any time, i.e. providing a formwork which travels by itself in all three types of operation.

In accordance with the present invention a self-travelling support and slide formwork is provided as defined in claim 1. Advantageous embodiments of the invention are given in the subclaims.

Figure 1:
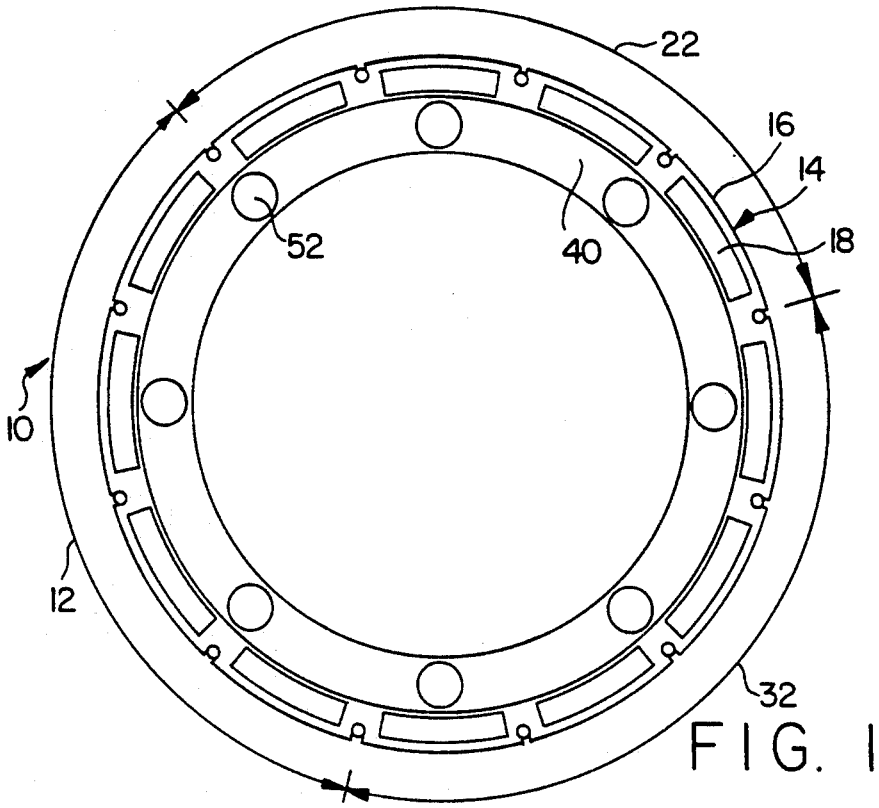
Figure 2:
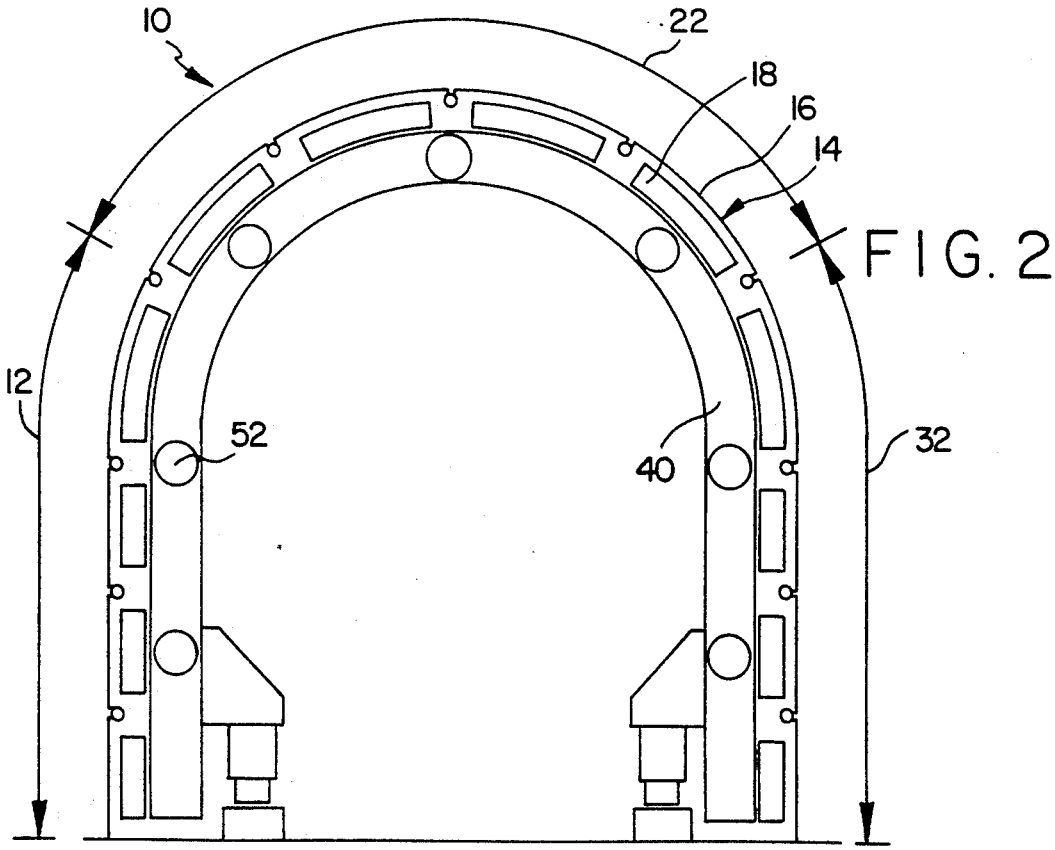
Figure 3:
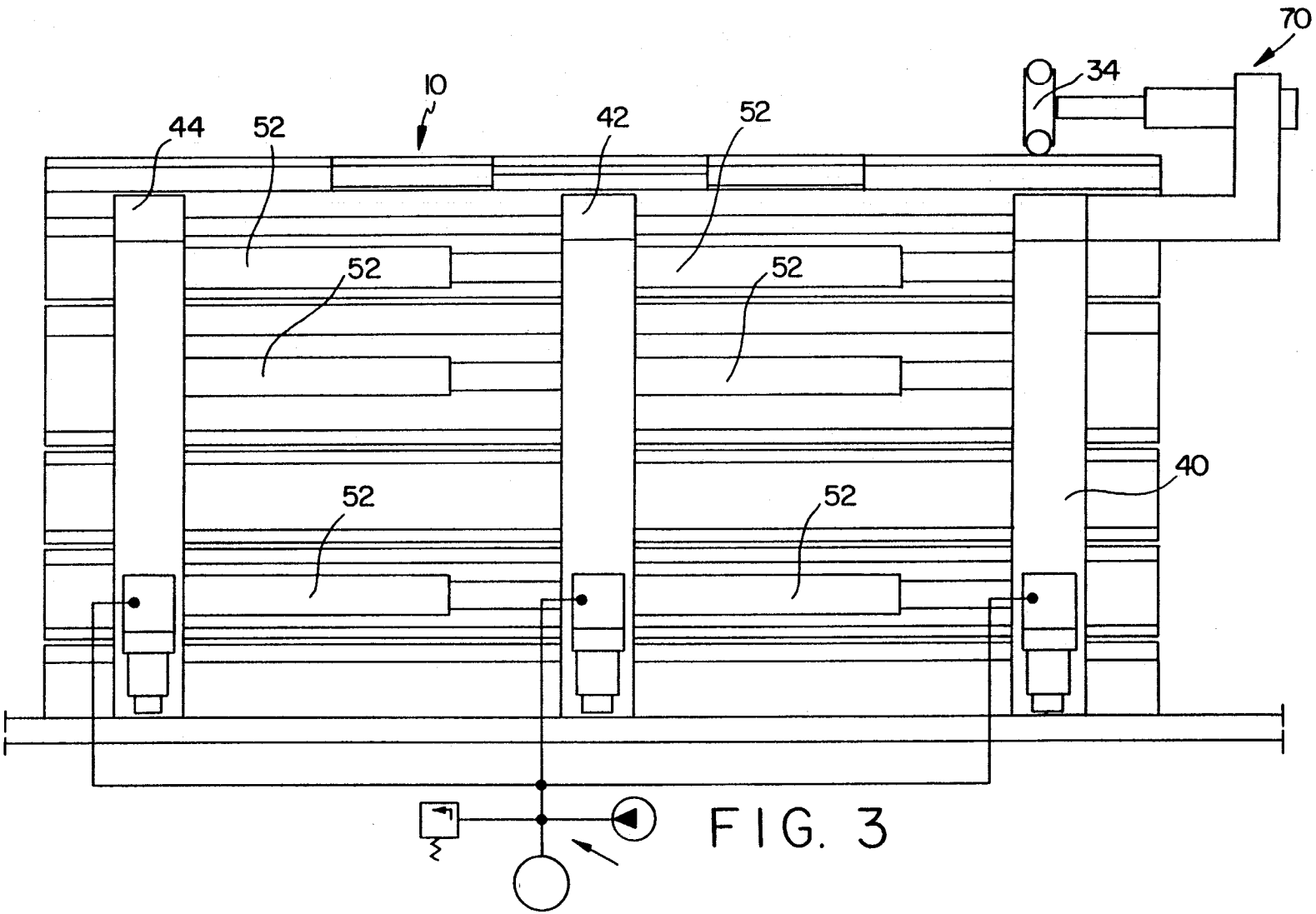
Figure 4A:
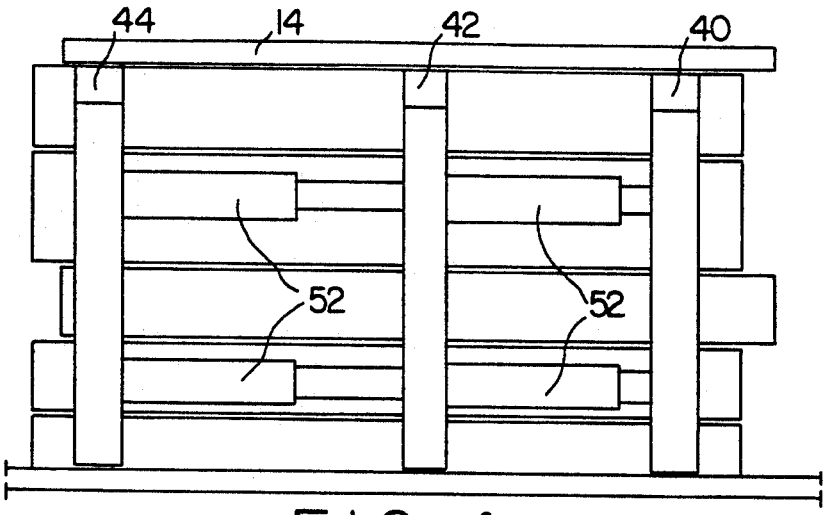
Figure 5:
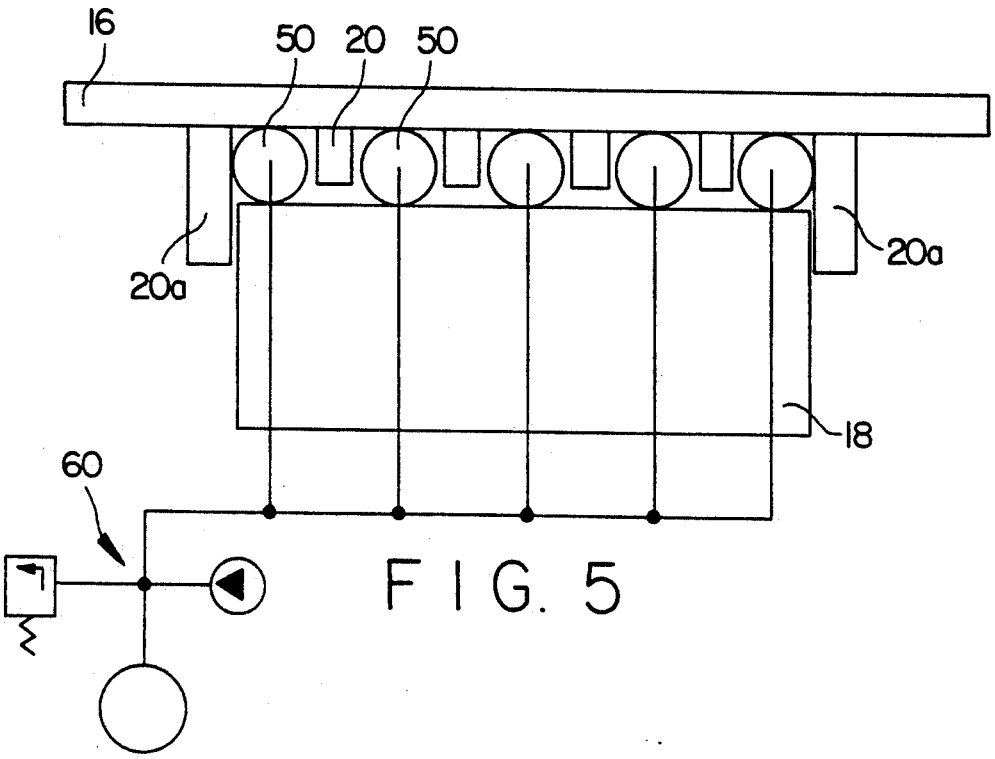
Figure 7:
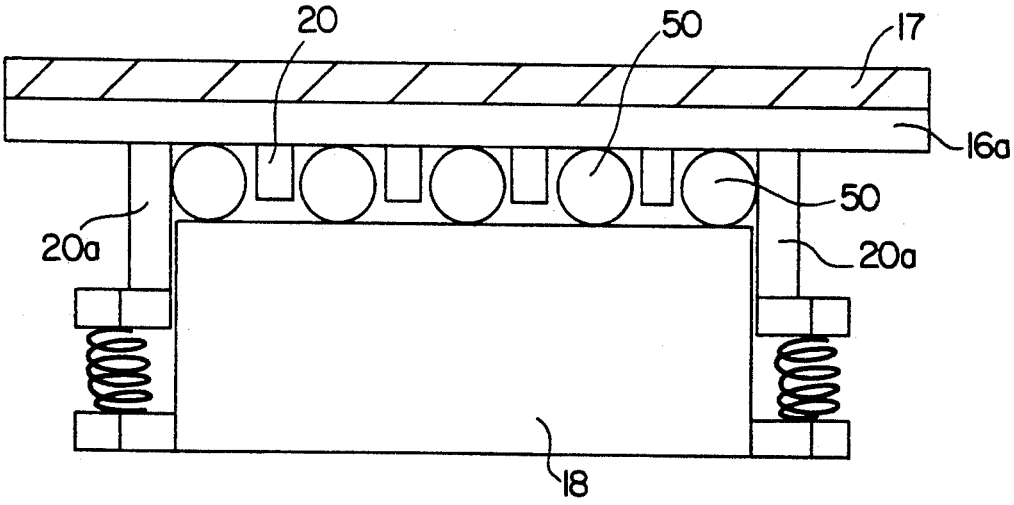
Figure 6:
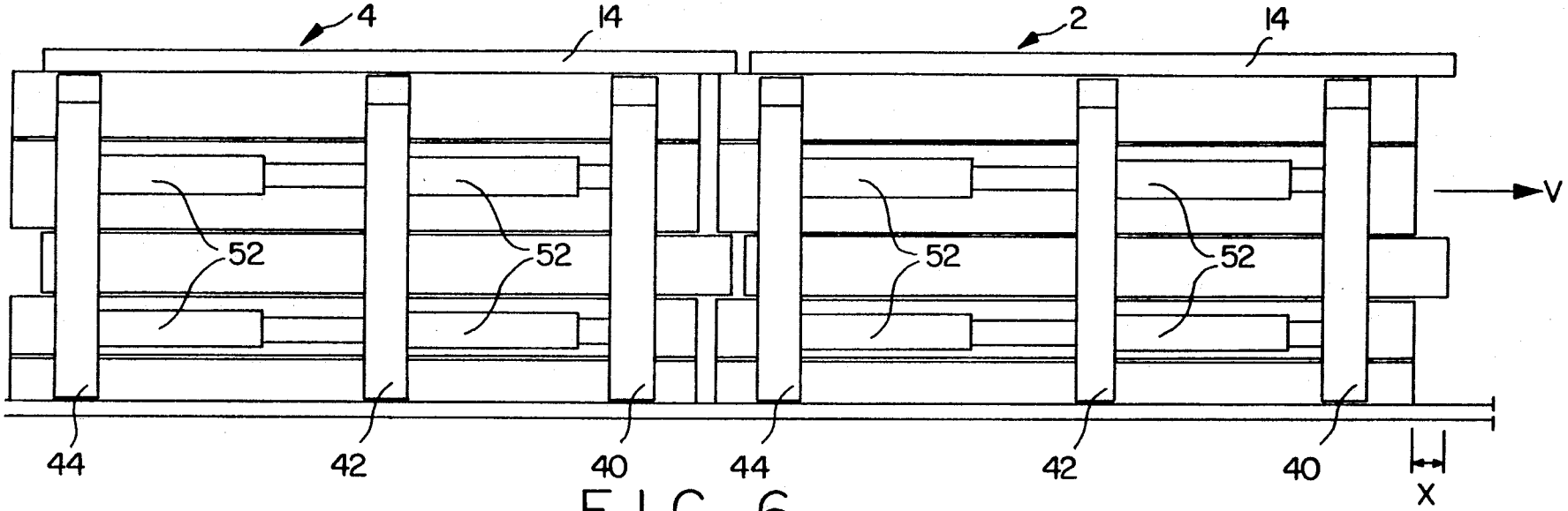
Figure 8:
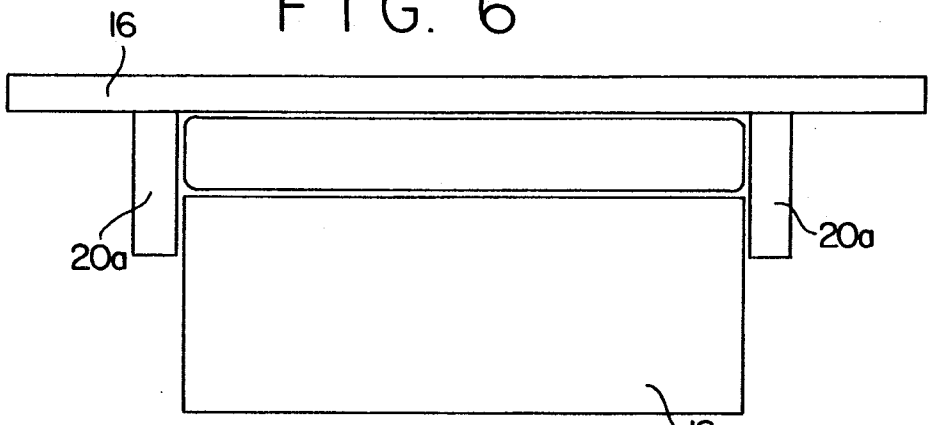

The present invention is described in the following by way of an example in conjunction with the drawings, which show:

FIG. 1 a schematic sectional view of a tunnel with circular cross-section, by which the entire profile is concreted in one working step;

FIG. 2 a sectional view of a tunnel with an arch-shaped cross-section and a floor, by which the floor has been preconcreted and the sidewalls and crown are concreted with the formwork of the present invention;

FIG. 3 a schematic longitudinal section of the slide formwork of FIG. 2 with one embodiment of a front formwork;

FIGS. 4*a, b, c* various slide movements of a slide formwork in accordance with the invention;

FIG. 5 a schematic representation of a formwork segment;

FIG. 6 a variation, by which the slide formwork has two parts in the form of a preadvancing, finishing formwork followed by a similar support formwork;

FIG. 7 a cross-sectional view of a formwork segment of the support formwork in FIG. 6 and;

FIG. 8 a schematic cross-sectional view of another embodiment of the hydraulic drive means of the formwork elements.

Figure 4B:
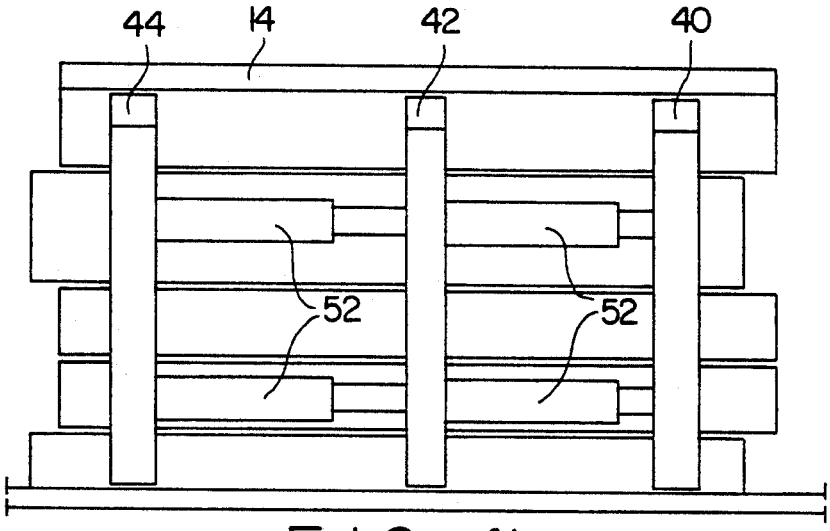
Figure 4C:
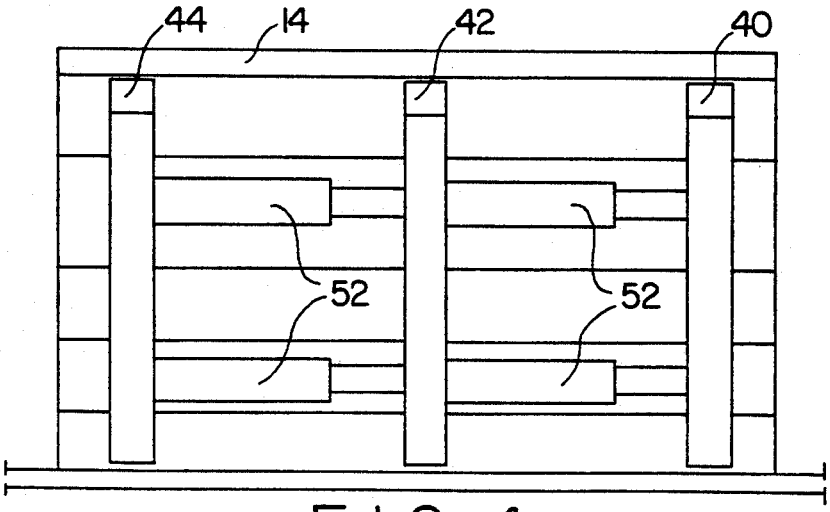

A formwork body 10 is provided in the embodiment shown in cross-section in FIG. 1 and also FIG. 2 of a self-travelling support and slide formwork which is subdivided into several formwork segment groups 12, 22 and 32 lying adjacently in circumferential direction and parallel to the axis. In the embodiment shown, each segment group 12, 22 and 32 comprises four individual formwork segments 14 lying parallel to the axis. Each formwork segment 14 comprises a formwork element facing the concrete in the form of a formwork plate 16, which is connected to a support sub-construction in the form of a longitudinal carrier 18 by means of hydraulically operated transmission members shown in FIG. 5 as expandable hoses or tubes 50. The longitudinal carriers 18 are mounted on support frames, the foremost support frame 40 in the advancement direction being shown in FIGS. 1 and 2, while further support frames 42 and 44 are shown in FIGS. 3, 4 and 6.

The formwork plate 16 of all formwork segment groups together form an outer formwork surface of the formwork body 10. According to FIG. 3, the support and slide formwork also comprises a front formwork 34 which closes the front side of an annulus formed between the outer walls of the excavated structure or an outer form mounted there, for example an outer concrete shell and the formwork body 10. The front formwork 34 is supported via a hydraulic guide means 70 variable in length mounted on the foremost support frame 40 as seen in advancement direction.

The individual formwork segments 14 are shiftable longitudinally with respect to neighboring segments, while each formwork plate 16 is adjustable in height with respect to its longitudinal carrier 18. Sealing elements arranged along and between the sides of the formwork plates 16 seal the mentioned annulus, i.e. they prevent leakage of concrete into the interior of the formwork body 10. The formwork plate 16 and the associated carrier 18 of each formwork segment 14 are connected in longitudinal direction in non-shiftable manner, while the hydraulic transmission member in the form of expandable tubes 50 are arranged for each segment 14 between the plate 16 and the carrier 18.

Depending on the application, several formwork segments 14 are collected to form various formwork segment groups 12, 22 and 32. For a given slide formwork, just as many segment groups 12, 22 and 32 are provided as the number of support frames 40, 42 and 44. Each of the formwork segment groups 12, 22 and 32 is securely fixed to a different support frame 40, 42 and 44 and is slidably mounted to the remaining support frames.

As can be seen in FIGS. 3, 4 and 6 independently operable pressure/advancement members are arranged between the individual support frames 40, 42 and 44 in the form of hydraulic presses 52, with which each support frame 40, 42 and 44 is shiftable with respect to the other support frames.

In the embodiment shown in FIGS. 1 and 2, three formwork segment groups 12, 22 and 32 and three support frames 40, 42 and 44 are provided, where each segment group of the embodiment makes up about ⅓ of the formwork surface. Depending on the application, it is readily possible to provide more support frames and formwork segment groups and/or to variously select the width of the individual groups, for example by associating adjacent segments in neighboring segment groups to one group in a certain application and to another group in another application and securely fix to the support frame responsible for shifting the group. Important for this selection is the frictional force to be expected in the respective region of the formwork surface and/or the frictional forces acting on the formwork segments when they are shifted out of the neutral position. A two-part embodiment of a slide formwork in the form of travelling finishing formwork 2 and a similar support formwork 4 is illustrated in FIG. 6. The formwork segments 14 of the two formworks 2 and 4 are arranged to be in alignment with one another in the longitudinal direction.

In the embodiments of formwork segments shown in FIGS. 5 and 7, five parallel arranged groups of expandable tubes 50 are provided, which are displaced on the back side of the associated formwork plate 16 or **16*a* in respective chambers, defined by separation walls 20 and 20*a*. The separation walls 20 and 20*a* engage between and around the tubes 50. The outer separating walls 20*a* are elongated and engage about the associated longitudinal carrier 18 as side holding elements, so that a transverse shifting between the formwork plates 16 and 16*a* and the longitudinal carrier 18** is prevented.

The groups of expandable tubes 50 can be subdivided into individual chambers. According to FIG. 5, a hydraulic control arrangement 60 is provided by which a predetermined pressure value can be selectively maintained in the respective tubes 50 or tube chambers. The hydraulic arrangement 60 comprises a hydraulic pump and a pressure limiting valve associated with each tube 50 or each chamber, whose opening pressure is adjustable.

In the embodiment of FIG. 7, the formwork plate **16*a* is biased in a radially drawn back position with respect to the formwork surface by means of a tension spring. The formwork plate 16 also comprises an elastic deformable covering 17** on its side facing the formwork surface.

The operation of the self-travelling support and slide formwork will now be described in more detail based on FIGS. **4*a*, 4*b*, 4*c* and 6**.

To advance the framework, an arbitrary support frame, in FIG. **4*a* the central support frame 42, including the formwork segment groups secured to this support frame 42 (not shown in detail in the drawing) is shifted by a preselected step length x by means of the presses 52 arranged on the support frames 40, 42 and 44. Before beginning the shifting, the expandable tubes 50 of the associated segment groups are switched to transport position, i.e. the pressure existing in the expandable tubes is held at a preselected value by the associated pressure limiting valves and the hydraulic pump provided in the hydraulic arrangement 60. In this manner, the formwork plate 16, 16*a* lying next to the concrete wall can react to changes in the surface of the concrete wall, i.e. they relax is the pressure increases or are driven out if the pressure decreases. For example when the plate 16 of a formwork segment group 12, 22 or 32 comes to a narrow section in the concrete, an increase in pressure is compensated by a pressure release valve, so that the concerned formwork plate 16 or 16*a* can move inwardly. On the other hand, if the pressure in the expandable tubes starts to drop when passing a wider section, the pressure is maintained by the hydraulic pump and the concerned formwork plate 16 or 16*a*** are moved radially outwardly.

As shown in the FIGS. **4*b* and 4*c*, the back support frame 44 with its associated formwork segment groups and then the front support frame 40 with its segments groups are shifted forward respectively by the step length x. When one of the support frames 40, 42 and 44 with its associated segment groups 12, 22 and 32** is shifted forward, it acts by means of the presses engaging against at least one of the other support frames, whereby the stationary support frames hold their formwork segment groups against the concrete wall.

In FIG. 2, the formwork is carried on a guide rail, not shown in detail, by means of hydraulic support means, not shown in more detail. The pressure in these support means is also controlled so that uneven locations in the guide path, as well as convergences or divergences in the path along the longitudinal axis of the formwork can be compensated, by correspondingly driving the support cylinder inwards or outwards.

In FIG. 3, the front formwork 34 is sealed along the circumference of the annulus to be filled with concrete by a sealing, not shown in more detail. In addition, the front formwork 34 is carried by a piston longitudinally shiftable in a pressure cylinder of the hydraulic driving means 70. Since the driving means 70 is rigidly secured on the foremost support frame 40 as seen in advancement direction, the relative position of the front formwork 34 with respect to the annular closed front cross-section of the formwork surface can be maintained, regardless of whether all of the formwork segment groups together form the front annular surface or one or more of the formwork segment groups has been shifted. In addition, the hydraulic drive of the front formwork 34 enables the advancement of the formwork body 10 with its formwork surface, the advancement being independent to a certain degree of the introduction of concrete into the annulus.

When the force of the concrete pumped into the front formwork is sufficient compared to the friction forces, the entire formwork can be moved forward as in the case of the known support and slide formwork of this type, without the above described movement of the formwork in partial steps of the segment groups being necessary.

When concreting in charge operation, i.e. an operation where the formworking and concreting take place one after the other, the formwork plate 16 of each segment group 12, 22 and 32 could be removed from the concrete wall for forward advancement to prevent frictional resistance. The forward movement of the entire slide formwork can therefore take place in substeps, where the individual formwork segments or segment groups are pressed against the concrete wall again after advancement, in order to accept the reaction forces arising by advancement of the following segment groups.

The two-part embodiment shown in FIG. 6 for the support and slide formwork is suited for such cases, where the concerned concrete section does not as yet have the necessary load-carrying capacity. In this case, the following support formwork overtakes the task of support until the necessary load-carrying capacity is reached in the concrete section.

As discussed above, the following support formwork 4 is structured the same in principle as the prior finishing formwork 2. The segment groups of the finishing formwork 2 and the support formwork 4 are naturally chosen so that they lie in alignment in longitudinal direction with one another and are advanced together, so that no large gaps arise between the formwork segment groups. The support formwork segments are advantageously removed from the concrete wall before advancement. This is accomplished by equipping them with tension springs as shown in the embodiment of FIG. 7, which bias the plate 16*a* toward the associated longitudinal carrier 18. When the expandable tubes 50 are placed under less pressure or have no pressure, the formwork plate 16*a* is pulled back by the tension springs from the concrete wall.

In addition, in the embodiment shown in FIG. 7 of a support formwork segment, the formwork plate 16*a* has a covering 17 of elastic deformable material on the surface facing the concrete wall, which provides that the support formwork segment supports the full surface even in uneven areas of the concrete.

As the skilled person knows, it is possible, depending on the degree of hardening of the concrete wall to be supported, to form the support formwork segments with a smaller width than the actual formwork segments or when a certain load-carrying capacity of the concrete is already present, to only support certain areas, for example the crown or arch region.

FIG. 8 shows a further embodiment of a hydraulic support of the formwork elements. According to FIG. 8, a flexible tube 55 is arranged between the opposing surfaces of the longitudinal carrier 18 and the framework plate 16. The enclosed chamber is closed along the sides by longitudinal side walls 20*a*, which are attached to the framework plate 16.

The flexible tube 55 only has a sealing function. The pressure of the hydraulic fluid is taken up by the chamber or the hollow space enclosed by the walls 16, 18 and 20*a*.

I claim:

1. Self-travelling support and slide formwork for producing a concrete lining when finishing a gallery or tunnel or similar elongated structure with a formwork body (10) extending in the longitudinal direction of the structure and substantially parallel to its excavation wall, which is subdivided into several formwork segments (14) lying adjacent to one another in circumferential direction, where each formwork segment (14) comprises an outer formwork element (16, 16*a*) supported on an associated subconstruction (18), where the formwork elements (16 16*a*) collectively form an outer formwork surface, with a front formwork (34) which closes the front side of an annular space between the excavated wall of the structure (2) and the formwork body (10) and with a support construction carrying at least the subconstruction (18) of the formwork segments (14) comprising several support frames (40, 42, 44) arranged next to one another, where the support forces to be exerted by the formwork surface on the incoming concrete can be applied to the effective formwork outer surface by means of hydraulically driven transmission members (50), characterized in that the formwork segments (14) form formwork segment groups, that at least as many formwork segment groups (12, 22, 32) are provided as the number of support frames (40, 42, 44), that each formwork segment group (12, 22, 32) is rigidly connected to a different support frame (40, 42, 44) and is slidably mounted on the remaining support frames (40, 42, 44), that in each formwork segment (14) the transmission member (50) is arranged between the formwork element (16, 16*a*) and its associated subconstruction (18), that the formwork elements (16, 16*a*) and the associated subconstructions (18) are coupled in non-shiftable manner in longitudinal direction and that independently operable pressure/advancement means (52) are arranged between the individual support frames (40, 42, 44), with which each support frame (40, 42, 44) is shiftable with respect to the remaining support frames (40, 42, 44).

2. Slide formwork according to claim 1, characterized in that three formwork segment groups (12, 22, 32) and three support frames (40, 42, 44) are provided.

3. Slide formwork according to claim 1, characterized in that the subconstructions of each formwork segment (14) are formed as a longitudinal carrier (18), which is rigidly secured to one of the support frames (40, 42, 44).

4. Slide formwork according to claim 1, characterized in that the formwork elements are formwork plates (16, 16*a*) between which sealings are arranged closing the formwork surface.

5. Slide formwork according to claim 1, characterized in that the hydraulic driven transmission members comprise expandable tubes (50).

6. Slide formwork according to claim 5, characterized in that in each formwork segment (14), at least two groups of expandable tubes (50) extending in longitudinal direction are arranged adjacent to one another.

7. Slide formwork according to claim 6, characterized in that separation walls (20, 20*a*) are arranged on the backside of each formwork plate (16, 16*a*), which extend between and about the tubes (50).

8. Slide formwork according to claim 7, characterized in that the outer separation walls (20*a*) engage about the associated longitudinal carrier (18) simultaneously as side holding elements and prevent a transverse shifting between formwork plate (16, 16*a*) and longitudinal carrier (18).

9. Slide formwork according to claim 8, characterized in that each tube group is formed from a continuous tube (50).

10. Slide formwork according to claim 8, characterized in that each tube group comprises several separately operatable tubes arranged after one another or tube chambers.

11. Slide formwork according to claim 8, characterized in that a hydraulic control arrangement (60) is provided with which a pre-adjusted pressure can be maintained selectively in each of the tubes (50) or tube chambers.

12. Slide formwork according to claim 11, characterized in that the hydraulic arrangement (60) comprises a hydraulic pump and an associated pressure limit valve for each tube (50) or each chamber, whose opening pressure is adjustable.

13. Slide formwork according to claim 1, characterized by a two-piece configuration in the form of one pre-advancing finishing formwork (2) and a similar following support formwork (4), whose formwork segments (14) are arranged in alignment with one another in longitudinal direction.

14. Slide formwork according to claim 13, characterized in that the formwork plates (16) of the support formwork (4) are biased into a position radially inwardly with respect to the formwork surface.

15. Slide formwork according to claim 13, characterized in that the formwork plates (16) of the support formwork (4) comprise an elastic deformable covering (17) on the side of the formwork surface.

16. Slide formwork according to claim 1, characterized in that the front formwork (34), which engages about the formwork surface in sealing manner, is supported on the foremost support frame (40) by a hydraulic operated, longitudinally shiftable driving means (70).

17. Slide formwork according to claim 5, characterized in that the hydraulic operated transmission member in one formwork segment is formed as a flexible tube filling out a chamber, which is formed between the formwork element (16) and the associated subconstruction (18) and is enclosed along the longitudinal sides by side walls (20*a*).

* * * * *